US006865772B2

(12) United States Patent
Risch

(10) Patent No.: US 6,865,772 B2
(45) Date of Patent: Mar. 15, 2005

(54) TIRE DRESSING KIT

(76) Inventor: Randolph L. Risch, 7498 E. Sitka Ct., Port Orchard, WA (US) 98366

( * ) Notice: Subject to any disclaimer, the term of this patent is extended or adjusted under 35 U.S.C. 154(b) by 66 days.

(21) Appl. No.: 10/358,694

(22) Filed: Feb. 4, 2003

(65) Prior Publication Data

US 2003/0172486 A1 Sep. 18, 2003

Related U.S. Application Data

(60) Provisional application No. 60/365,627, filed on Mar. 18, 2002.

(51) Int. Cl.[7] ..... A47L 25/00; B05C 17/00

(52) U.S. Cl. ..... 15/244.1; 15/104.94; 15/244.1; 15/257.05; 401/11

(58) Field of Search ..... 15/210.1, 244.1, 15/244.3, 244.4, 257.05, 104.93, 104.94; 401/10, 11; D4/137; D32/35, 40, 50

(56) References Cited

U.S. PATENT DOCUMENTS 3,242,519 A * 3/1966 Murray ..... 15/244.1
4,601,081 A * 7/1986 Sutton et al. ..... 15/104.94
4,811,991 A 3/1989 Moreno et al. ..... 301/37
4,963,045 A 10/1990 Willcox ..... 401/132
5,159,735 A * 11/1992 Owens et al. ..... 15/104.94
5,542,352 A * 8/1996 Blackman et al. ..... 101/483
5,896,616 A 4/1999 Large ..... 15/244.1
5,987,694 A 11/1999 Large ..... 15/244.1
6,485,212 B1 * 11/2002 Bomgaars et al. ..... 401/11

* cited by examiner

*Primary Examiner*—Robert J. Warden, Sr.
*Assistant Examiner*—Shay L Balsis
(74) *Attorney, Agent, or Firm*—Dean A. Craine

(57) ABSTRACT

An applicator used to evenly apply liquid tire dressing to the entire outer sidewall of a tire. The applicator includes a pad that includes an elongated, concave, curved lower surface that is complementary in shape with a portion of the sidewall. The pad includes at least one beveled, concave lateral edge that enable the tire dressing to be applied evenly to the areas of the sidewall adjacent to the wheel hub and to the compressed shoulder area of the tire adjacent to the ground. The pad is attached to a rigid base that includes a rigid handle aligned parallel to the longitudinal axis of the pad and rigid base and that allows the user to easily hold the applicator perpendicular to the sidewall and move the applicator in long broad strokes in a circular pattern around the sidewall of a tire. An optional holding tray is also provided that temporarily stores the applicator and prevents the tire dressing from drying out.

6 Claims, 4 Drawing Sheets

TIRE DRESSING KIT

This is a utility patent application which claims benefit of U.S. Provisional Application No. 60/365,627 filed on Mar. 18, 2002.

BACKGROUND OF THE INVENTION

1. Field of the Invention

This invention relates to brushes and cleaning devices and, more particularly, to such devices used with motor vehicle tires.

2. Description of the Related Art

Liquid tire dressing products are commonly used to clean and beautify tires on a motor vehicle. Because such products contain silicone and other chemicals that can damage or leave a film on other surfaces, great care must be used when applying a tire dressing product.

Typically, tire dressing products are dispensed from a spray bottle or pressurized can. While overspray may be a typical problem for inexperienced users, it is difficult even for experienced users to achieve an even layer of product over the sidewall of the tire. It is especially difficult to apply the product to the area of the sidewall immediately adjacent to the wheel rim and to the area of the sidewall located against the ground.

It is commonly known that long, broad strokes are desired when painting a large surface with a paintbrush. When applying tire dressing to a motor vehicle tire, it is desirable to use long, broad, circular strokes that follow the tire sidewall. Ideally, the user's hand and the applicator should be properly aligned to the tire so that the applicator can be moved in a continuous, circular path over the tire.

SUMMARY OF THE INVENTION

It is an object of the present invention to provide an applicator for applying a liquid tire dressing to the sidewall of a tire.

It is another object of the invention to provide such an applicator that allows the user to apply tire dressing to the areas of the sidewall immediately adjacent to the wheel hub and the section of the tire shoulder immediately adjacent to the ground.

It is a further object of the invention to provide such an applicator that allows the user to easily move the applicator in a circular pattern around the tire.

These and other objects are met by the applicator disclosed herein that is used to evenly apply liquid tire dressing to the entire outer sidewall of a tire. The applicator includes a pad with an elongated, concave, curved, bottom surface that is complimentary in shape to a portion of the sidewall. The pad includes curved, beveled lateral edges that enable the tire dressing to be applied evenly to the areas of the sidewall adjacent to the wheel hub and to the compressed shoulder area of the tire adjacent to the ground. The top surface of the pad is attached to a rigid base that includes a rigid handle aligned which is parallel to the longitudinal axis of the pad and that allows the user to hold the applicator perpendicular to the sidewall and easily move the applicator in long broad strokes in a circular pattern around the tire. An optional holding tray is also provided that temporarily stores the applicator between uses. An optional absorption pad may be placed inside the holding tray that creates a seal to prevent the tire dressing from drying out between applications.

DESCRIPTION OF THE PREFERRED EMBODIMENT(S)

Figure 1:
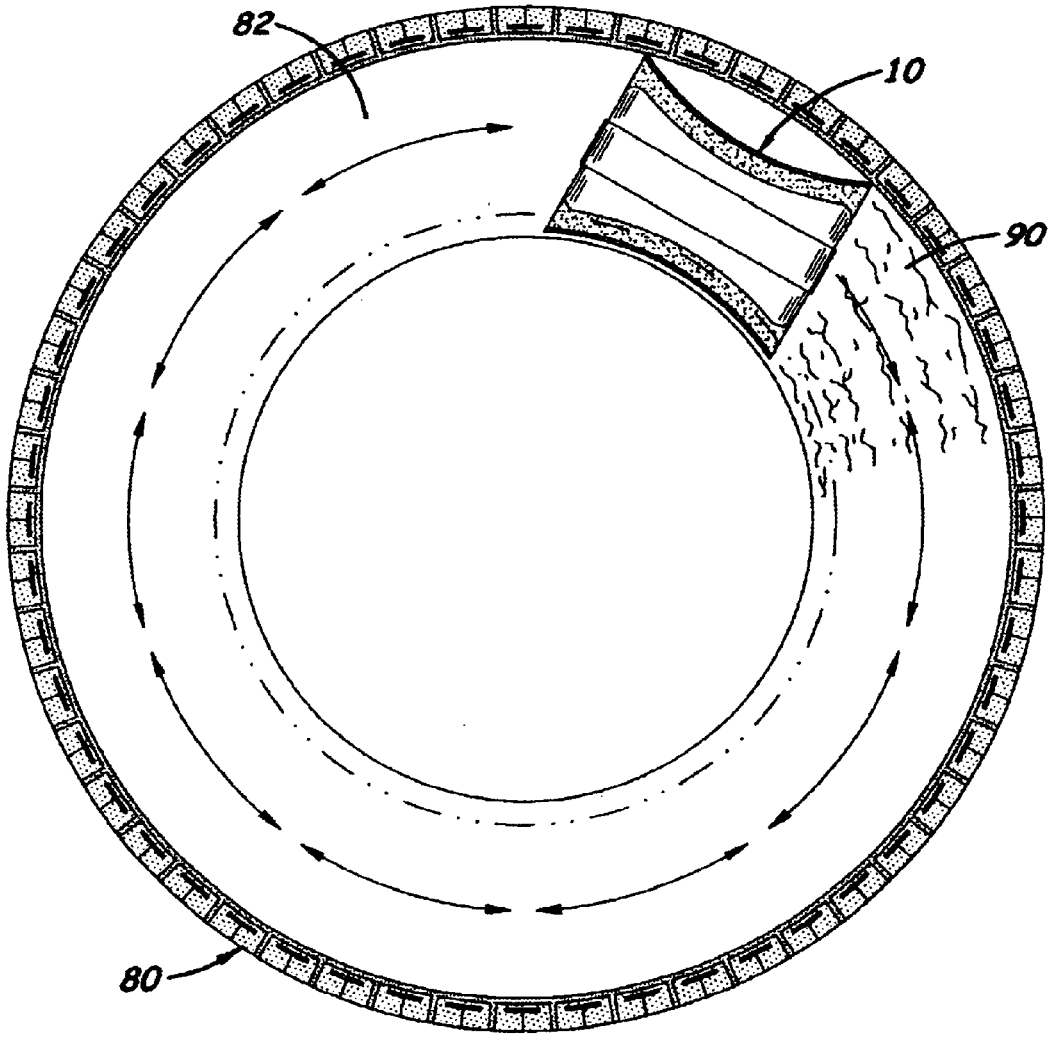
FIG. 1 is a side elevational view of a tire showing the tire dressing applicator being used to apply tire dressing to the tire outer sidewall.
Figure 2:
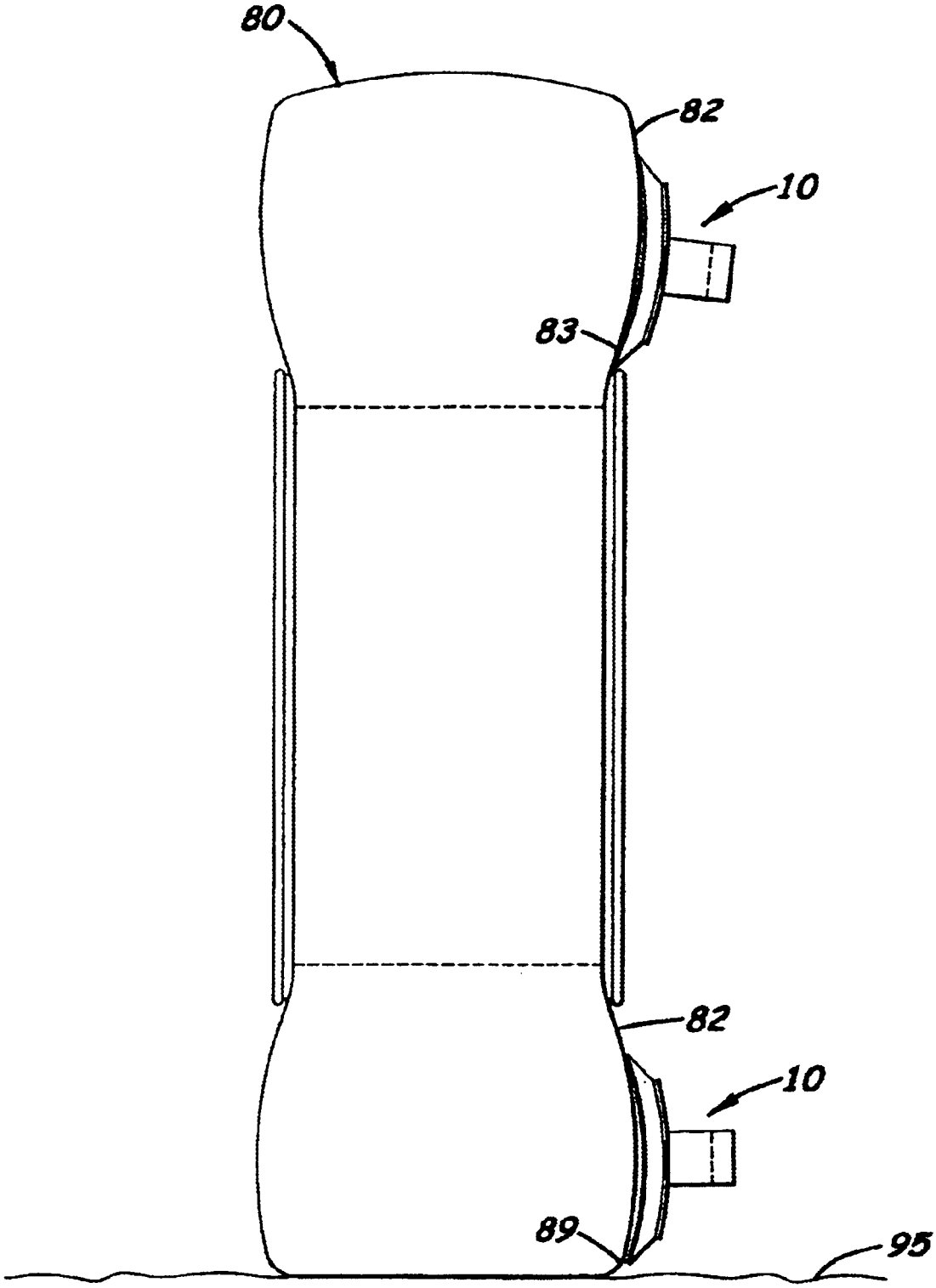
FIG. 2 is a front elevational view of a tire showing the applicator being used to apply tire dressing to the section of the sidewall immediately adjacent to the wheel and to the shoulder area immediately adjacent to the ground.
Figure 3:
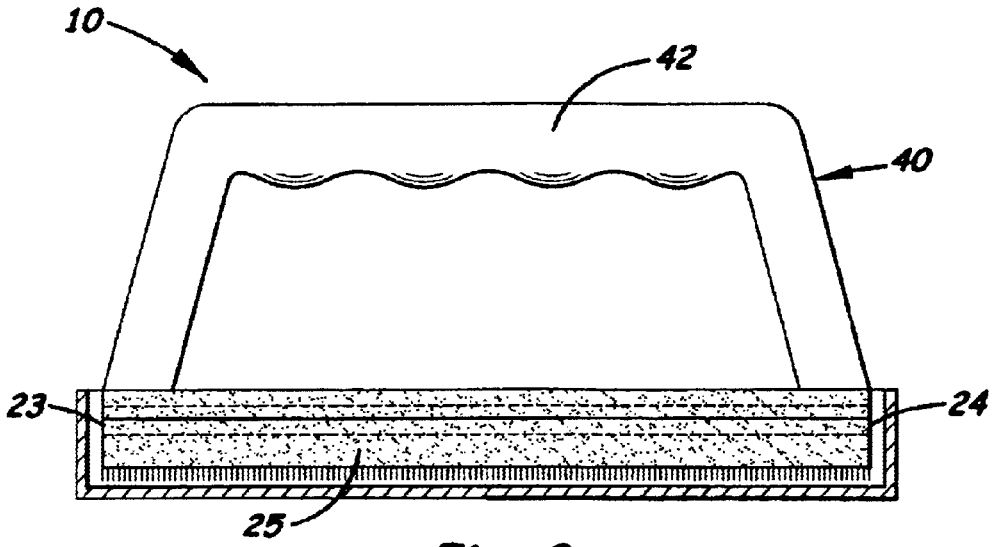
FIG. 3 is a side elevational view of the applicator.
Figure 4:
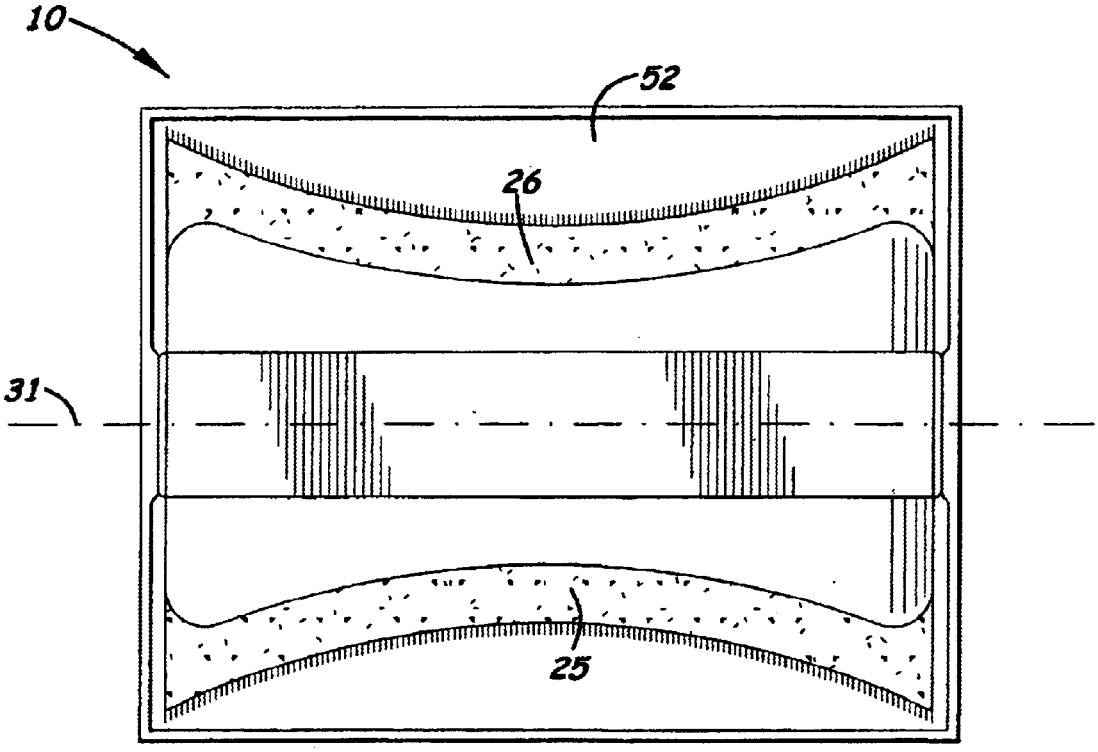
FIG. 4 is a top plan view of the applicator.
Figure 5:
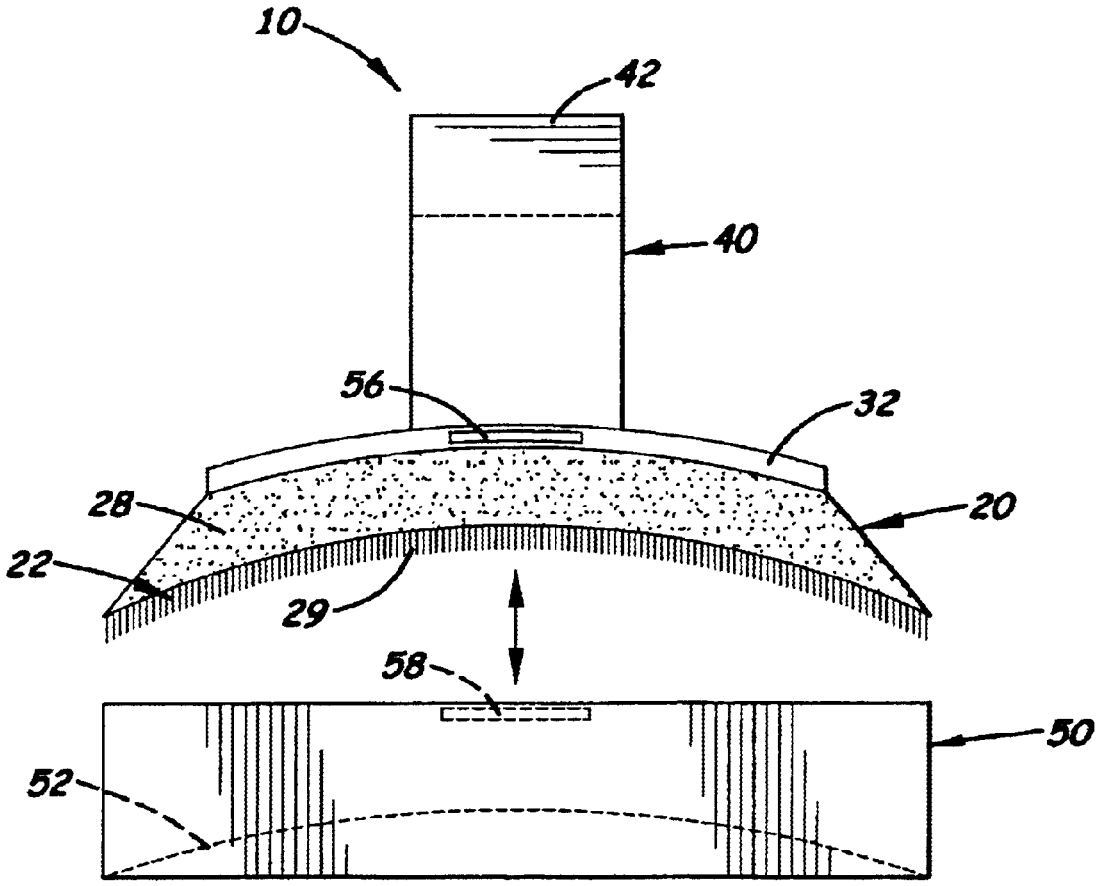
FIG. 5 is a front elevational view of the applicator.

Shown in the accompanying FIGS. 1–5, there is shown an applicator 10 specifically designed to assist individuals to apply a liquid tire dressing 90 to the sidewall 82 on a tire 80. The applicator 10 includes a resilient pad 20 with an elongated, concave, curved bottom surface 22 that is complementary in shape with the outer curvature of the sidewall 82. The end surfaces 23, 24 of the pad 20 are straight and vertically aligned while the lateral edges 25, 26 are concave towards longitudinal axis 31 of the rigid base 32, as shown in FIG. 4. The lateral edges 25, 26 are also slightly beveled outward and downward, as shown in FIG. 3. The curved and beveled shape of the lateral edges 25, 26 enable tire dressing 90 to be applied evenly to the areas 83 of the sidewall 82 adjacent to the wheel hub 88 and to the compressed shoulder area 89 of the tire 80 adjacent to the ground 95. As shown in FIG. 5, the pad 20 is made of an upper foam rubber layer 28 with an optional lower cloth or fabric layer 29 attached thereon. The foam rubber layer 28 measures approximately 5½ inches in length, 3 inches in width, and ¾ inches in thickness. The lower fabric layer 29 covers the entire lower surface of the foam rubber layer 28 and measures approximately ⅛ inch thick.

The pad 20 is adhesively attached to a rigid base 32 that is approximately the same size and shape as the top surface of the pad 20. In the preferred embodiment, the rigid base 32 is slightly concave when viewed from the front, as shown in FIG. 5, and is made of plastic approximately 3/16 inch thick. Longitudinally aligned over the center longitudinal axis 31 of the rigid base 32 is an upward extending handle 40. The handle 40 includes a straight section 42 that extends substantially parallel to the rigid base 32 and pad 20 so that the user may easily hold the applicator 10 perpendicular to the sidewall and push or pull the applicator 10 in a circular path around the sidewall 82 of the tire 80, as shown in FIG. 2.

An optional holding tray 50 is also provided that temporarily stores the applicator 10 between uses. The holding tray 50 may include an upward extending convex support surface 52 upon which the applicator 10 is placed when stored in the tray 50. The support surface 52 may be made of absorbent material or may include an absorbent pad (not shown) that absorbs the tire dressing 90 and that can be transferred to the pad 20 during storage. Optional brackets 56, 58, may also be formed on the edges of the rigid base 32 and the tray 50, respectively, that enable the applicator 10 to snap-fit into the tray 50.

In compliance with the statute, the invention described herein has been described in language more or less specific as to structural features. It should be understood, however, that the invention is not limited to the specific features shown, since the means and construction shown, is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. An applicator used to apply tire dressing to a tire, comprising:

a. a rigid base having a concave lower surface and a longitudinal axis;

b. an absorbent pad longitudinally aligned and attached to said concave lower surface of said rigid base, said pad including an elongated, concave lower surface that is complementary in shape with a sidewall of a tire, said pad including two opposite end surfaces and two opposite lateral edges, said lateral edges being concave and beveled thereby enabling tire dressing on said lower surface of said pad to be applied evenly to areas of a sidewall adjacent to a wheel hub and applied to a compressed shoulder area of a tire adjacent to the ground when said pad is moved in a circular pattern around a sidewall on a tire; and, c. a rigid handle attached to said rigid base opposite said pad, said rigid handle being aligned longitudinally with said longitudinal axis of said rigid base to allow the user to easily move the applicator in long broad strokes in a circular pattern around a sidewall of a tire.

2. The applicator, as recited in claim 1, wherein said pad is made of foam rubber.

3. The applicator, as recited in claim 2, wherein said pad includes a lower cloth or fabric layer.

4. The applicator, as recited in claim 1, further including a holding tray that temporarily stores said rigid base.

5. The applicator, as recited in claim 4, wherein said holding tray includes a second absorbent pad used to hold tire dressing, said second absorbent pad being used to transfer tire dressing to said absorbent pad attached to said applicator when said applicator is stored in said holding tray.

6. The applicator, as recited in claim 4, further including means for selectively holding said applicator in said holding tray.

* * * * *